US011959248B2

(12) United States Patent
Van Rompay

(10) Patent No.: US 11,959,248 B2
(45) Date of Patent: Apr. 16, 2024

(54) DEVICE FOR THE REMOVAL OF SLUDGE AND/OR SAND FROM THE BOTTOM OF A WETLAND

(71) Applicant: Boudewijn Gabriël Van Rompay, Clearwater, FL (US)

(72) Inventor: Boudewijn Gabriël Van Rompay, Clearwater, FL (US)

( * ) Notice: Subject to any disclaimer, the term of this patent is extended or adjusted under 35 U.S.C. 154(b) by 497 days.

(21) Appl. No.: 17/275,873

(22) PCT Filed: Sep. 12, 2019

(86) PCT No.: PCT/IB2019/057693
§ 371 (c)(1),
(2) Date: Mar. 12, 2021

(87) PCT Pub. No.: WO2020/053801
PCT Pub. Date: Mar. 19, 2020

(65) Prior Publication Data

US 2022/0056664 A1 Feb. 24, 2022

(30) Foreign Application Priority Data

Sep. 14, 2018 (BE) ..... 2018/5630

(51) Int. Cl.
*E02F 3/88* (2006.01)
*B63C 11/44* (2006.01)
(Continued)

(52) U.S. Cl.
CPC ..... *E02F 3/8841* (2013.01); *E02F 3/885* (2013.01); *E02F 3/907* (2013.01); *E02F 3/925* (2013.01); *E02F 3/9293* (2013.01); *B63C 11/44* (2013.01)

(58) Field of Classification Search
CPC ..... E02F 3/88; E02F 3/8833; E02F 3/8841; E02F 3/885; E02F 3/907; E02F 3/92;
(Continued)

(56) References Cited

U.S. PATENT DOCUMENTS 4,053,181 A * 10/1977 Saito ..... E21C 50/00 299/9
5,140,759 A * 8/1992 Artzberger ..... E02F 3/88 406/112

(Continued)

FOREIGN PATENT DOCUMENTS

BE 1018005 3/2010
BE 1021095 1/2016

(Continued)

OTHER PUBLICATIONS

International Search Report for PCT/IB2019/057693 dated Oct. 9, 2019, 4 pages.

(Continued)

*Primary Examiner* — Thomas B Will
*Assistant Examiner* — Audrey L Lusk
(74) *Attorney, Agent, or Firm* — NIXON & VANDERHYE

(57) ABSTRACT

A device for the removal of a layer of sludge and/or sand from the bottom of a wetland includes: a diving bell with an open bottom and a lower free edge; a unit for driving the diving bell with its lower edge into the layer of sludge to be removed; a dredge pump installed in the space of the diving bell and provided with an inlet for pumping up the sludge and/or an outlet to which a pipe is connected for pumping the pumped up sludge and/or sand to a collector; and a compressor for pumping gas under pressure into the space of the diving bell during dredging. The diving bell is also provided with a gas outlet for the compressed gas, the gas outlet being adjustable in height in the diving bell because the outlet is attached to a float that can float on the sludge.

20 Claims, 7 Drawing Sheets

(51) Int. Cl.
*E02F 3/90* (2006.01)
*E02F 3/92* (2006.01)

(58) Field of Classification Search
CPC ..... E02F 3/9243; E02F 3/925; E02F 3/9293; B60C 11/44; B09C 1/002
See application file for complete search history.

(56) References Cited

U.S. PATENT DOCUMENTS

| | | | | |
|---|---|---|---|---|
| 10,030,359 | B2 * | 7/2018 | Van Rompay | E02F 3/8841 |
| 10,450,720 | B2 * | 10/2019 | Van Rompay | E02F 3/907 |

FOREIGN PATENT DOCUMENTS

| | | | | | |
|---|---|---|---|---|---|
| JP | 60073921 | A | * | 4/1985 | E02F 3/88 |
| JP | 2-248535 | | | 10/1990 | |
| JP | 02248535 | A | * | 10/1990 | E02F 3/92 |
| WO | WO-8705649 | A | * | 9/1987 | E02F 3/8841 |

OTHER PUBLICATIONS

Written Opinion of the ISA for PCT/IB2019/057693 dated Oct. 9, 2019, 6 pages.

* cited by examiner

DEVICE FOR THE REMOVAL OF SLUDGE AND/OR SAND FROM THE BOTTOM OF A WETLAND

This application is the U.S. national phase of International Application No. PCT/IB2019/057693 filed Sep. 12, 2019 which designated the U.S. and claims priority to BE Patent Application No. 2018/5630 filed Sep. 14, 2018, the entire contents of each of which are hereby incorporated by reference.

BACKGROUND OF THE INVENTION

Field of the Invention

This invention relates to a method for the removal of sludge and/or sand from the bottom of a wetland.

The invention applies both to the removal of sludge and to the removal of an underlying sand layer up to a certain depth. For the sake of simplicity, the term sludge is used below, which also refers to the underlying sand layers.

More specifically, the method relates to the in situ pumping up of polluted sludge underwater with minimal turbulence.

Description of the Related Art

It is generally known that the sludge of maritime waterways may be contaminated with toxic chemicals and heavy metals from accidental or illegal discharges or from seepage from industrial sites, such as, for example, pollution by toxic substances that are often present on the hull of a ship to repel the growth of marine organisms.

These harmful substances remain present in the sludge of port areas and maritime waterways. These pollutions around port areas have a detrimental effect on the local indigenous marine organisms.

However, a problem is that current dredging techniques to remove sludge from the bottom of a wetland are often relatively inefficient in the sense that they create a lot of turbulence, causing sludge churn as well as turbidity or muddiness in the water.

The water content in the sludge is increased by the churning during dredging. This is not interesting because to clean the pumped up sludge, the moisture content has to be completely or partially removed. An increased moisture content therefore makes the dredging process relatively more expensive and the cleaning of the pumped up sludge more time-consuming.

Another disadvantage of the turbulence caused is that the churned polluted sludge spreads out over the wetland by resuspension of the sludge and possibly mixes with unpolluted sludge, while in fact the dredging and removal of the sludge should remain in situ as much as possible.

In addition, the precipitation of the resuspended sludge completely disturbs or even completely destroys soil organisms.

One consequence of the risk that a lot of turbulence is created using traditional sludge removal techniques, is that such polluted water bodies are left untouched by the authorities to avoid the risk of further dispersal through churn and inefficient removal.

This implies that polluted port areas are not deepened or expanded any further, which means that these areas with potentially high economic value remain unused.

In BE 1.018.005 and BE 1.021.095 of the same inventor, techniques are already known for in situ dredging, using a diving bell which is pushed into the sludge to be removed and from which the enclosed sludge is pumped away.

SUMMARY OF THE INVENTION

The purpose of the present invention is to further improve these known techniques using a diving bell.

To this end, the present invention relates to a device for the underwater in situ removal of sludge and/or sand from the bottom of a wetland, the device containing:

- a diving bell with an open bottom and a lower free edge;
- means of floating the diving bell with its lower edge to a desired depth into the layer of sludge and/or sand to be removed;
- a dredge pump installed in the space of the diving bell and provided with an inlet for pumping up the sludge and/or an outlet to which a pipe is connected for pumping the pumped up sludge and/or sand to a collector;
- a compressor for pumping gas under pressure into the space of the diving bell during dredging, whereby the diving bell is also provided with a gas outlet for the compressed gas, which gas outlet in the diving bell is adjustable in height because the outlet is attached to a float that can float on the sludge.

This movable outlet of the compressed gas will allow the air above the sludge or sand to escape freely when the diving bell is driven into the sludge or sand, so that the diving bell can be filled with sludge or sand as much as possible without the water being driven out.

The outlet will always be above the sludge or sand to be removed and the float, together with the movable outlet and the supply of the compressed gas, ensure that the water level and the pressure above the water in the bell are self-regulating.

Indeed, the air in the diving bell will be able to escape through the outlet, and the water level will stabilise at the level of the upper edge of the outlet.

As the float and therefore also the outlet mounted on it follow the level of the sludge, the level of the water will also follow the level of the sludge or sand and therefore the level of the sludge or sand and the level of the water will decrease together as more sludge or sand is pumped away.

Because both levels drop at the same time, there is no flow of water through the sludge to the outside, so that the pollution cannot escape to the outside and, in other words, during dredging, the pollution is retained inside the diving bell.

Such automatic regulation of the level and pressure is very simple and very effective as has already been demonstrated in closed trials.

According to a practical embodiment, the aforementioned outlet is formed by the open end of a pipe which, through an opening at the top of the diving bell, releases into the environment and, for example, is guided above the water surface via a further pipe to prevent turbulence and turbidity caused by rising air bubbles or to be able to purify toxically charged air if necessary.

The float with the outlet on it is preferably suspended in the diving bell by means of a chain or the like, whereby the length of this chain is such that when the diving bell is taken out of the water, the float with its underside is approximately at the level of the lower edge of the diving bell and when the diving bell is driven into the sludge, the float immediately comes into contact with the rising sludge in the diving bell.

Preferably, the float is such that it floats on the sludge or sand, but still does not have sufficient buoyancy to, together with the weight of the pipe, float the compressed gas outlet on the water.

The float, for example, is formed by a sufficiently dimensioned sheet to support the weight of the pipe on the sheet on the sludge or sand.

According to a simple practical embodiment, the pipe is formed by a rigid metal tube which rests and is attached to the float with one end and, with the other end, releases into the outside environment of the diving bell via a flexible coupling at the top of the diving bell.

Preferably, the dredge pump is attached at a fixed location in the diving bell so that it is floated into the sludge together with the diving bell and the inlet of the dredge pump is situated at the level of the lower free edge of the diving bell.

To obtain the aforementioned balance in the diving bell, a compressor is used, the pressure of which is set to a maximum pressure higher than the pressure of a water column with a height equal to the difference in level between the water surface of the wetland and the lower free edge of the diving bell.

Optionally, the diving bell near the lower edge can be provided with one or more water jets that are fed by a jet pump that injects water into the sludge or sand, which can be useful when the sludge is a hard substance.

To drive the diving bell into the sludge, for example, a hydraulic crane or excavator with a hydraulic unit group that supplies the hydraulic power to drive the dredge pump and the optional jet pump, whereby the diving bell is suspended from the crane's arm, can be used.

For example, the hydraulic crane is installed on a work boat or pontoon, together with the aforementioned compressor.

The means to drive the diving bell into the sludge or the sand may include a vibration or pile-driving installation, which may be mounted on the crane, for example.

To allow the crane operator to see or know what he is doing, means can be provided to assess the depth of the diving bell in the layer of sludge or sand as well as means to assess the thickness of the sludge layer.

The invention also relates to a method for the underwater in situ dredging of sludge or sand.

BRIEF DESCRIPTION OF THE DRAWINGS

With the intention of better showing the characteristics of the invention, some preferred embodiments according to the present invention are described hereinafter by way of an example, without any limiting nature, with reference to the accompanying drawings, wherein:

FIGS. 2 to 4 show the device of FIG. 1 during consecutive phases of the dredging in one and the same place;

DESCRIPTION OF THE PREFERRED EMBODIMENTS

Figure 1:
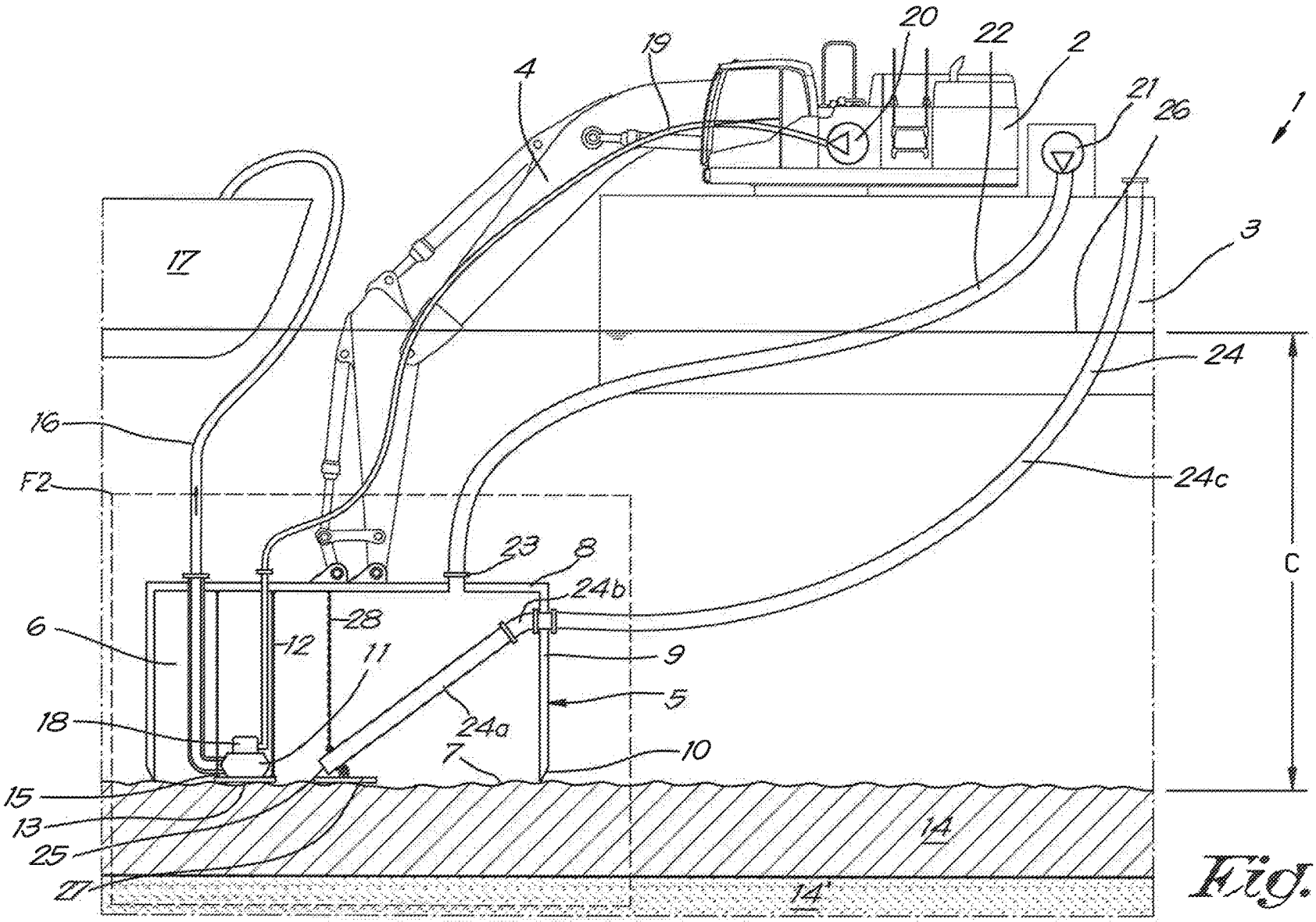
FIG. 1 schematically shows a device according to the invention at the start of the dredging.

The device 1 according to the invention as shown in FIG. 1 by way of an example, contains the following elements:

- a hydraulic crane 2 set up on a pontoon 3;
- a diving bell 5 suspended from the arm 4 of the crane 2 with an internal space 6 with an open bottom 7 which is delimited by an upper wall 8 and sidewalls 9, the lower edge 10 of which is made like a blade;
- a dredge pump 11 which is attached in the space 6 of the diving bell 5 by means of a rigid suspension 12 and which is provided with an inlet 13 for pumping up the sludge 14 and an outlet 15 to which a pipe 16 is connected to pump the pumped up sludge to a collector 17;
- a hydraulic motor 18 to drive the dredge pump 11, the motor 18 being connected via pipes 19 to the hydraulic unit 20 of the crane 2;
- a compressor 21 which is installed on the pontoon 3 to pump air under pressure during dredging via a supply pipe 22 and a passage 23 in the upper wall 8 into the space 6 of the diving bell 5.
- a discharge pipe 24 to evacuate the pumped air through a gas outlet 25 from the diving bell 5 to the open air above the water level 26, whereby the part of the discharge pipe 24 in the diving bell 5 is made as a rigid metal tube 24*a* connected with one end via a flexible coupling 24*b* to the part 24*c* of the discharge pipe 24 on the outside of the diving bell 5, in such a way that the tube 24*a* with the gas outlet 25 on the other end can rotate around the flexible coupling 24*b* down and up;
- a float 27 that can float on the sludge 14 and to which the end of the tube 24*a* with the outlet 25 is attached;
- a chain 28 with which the lower end of the tube 24*b* is suspended in the diving bell 5 and the length of which is such that the freedom of movement of the float 27 is restricted to the situation as shown in FIG. 1 whereby the underside of the float 27 is on the same level as the lower edge 10 of the diving bell 5.

The use of the device 1 according to the invention is simple and as follows.

Using the hydraulic crane 2 the diving bell 5 is pushed down and, together with the dredge pump 11, is driven into the sludge 14 with the blade at the lower edge 10 of the diving bell 5 in a horizontal position.

When the diving bell 5 reaches the level of the sludge 14 as in the initial situation of FIG. 1, the float 27 lies just above the sludge 14.

Figure 2:
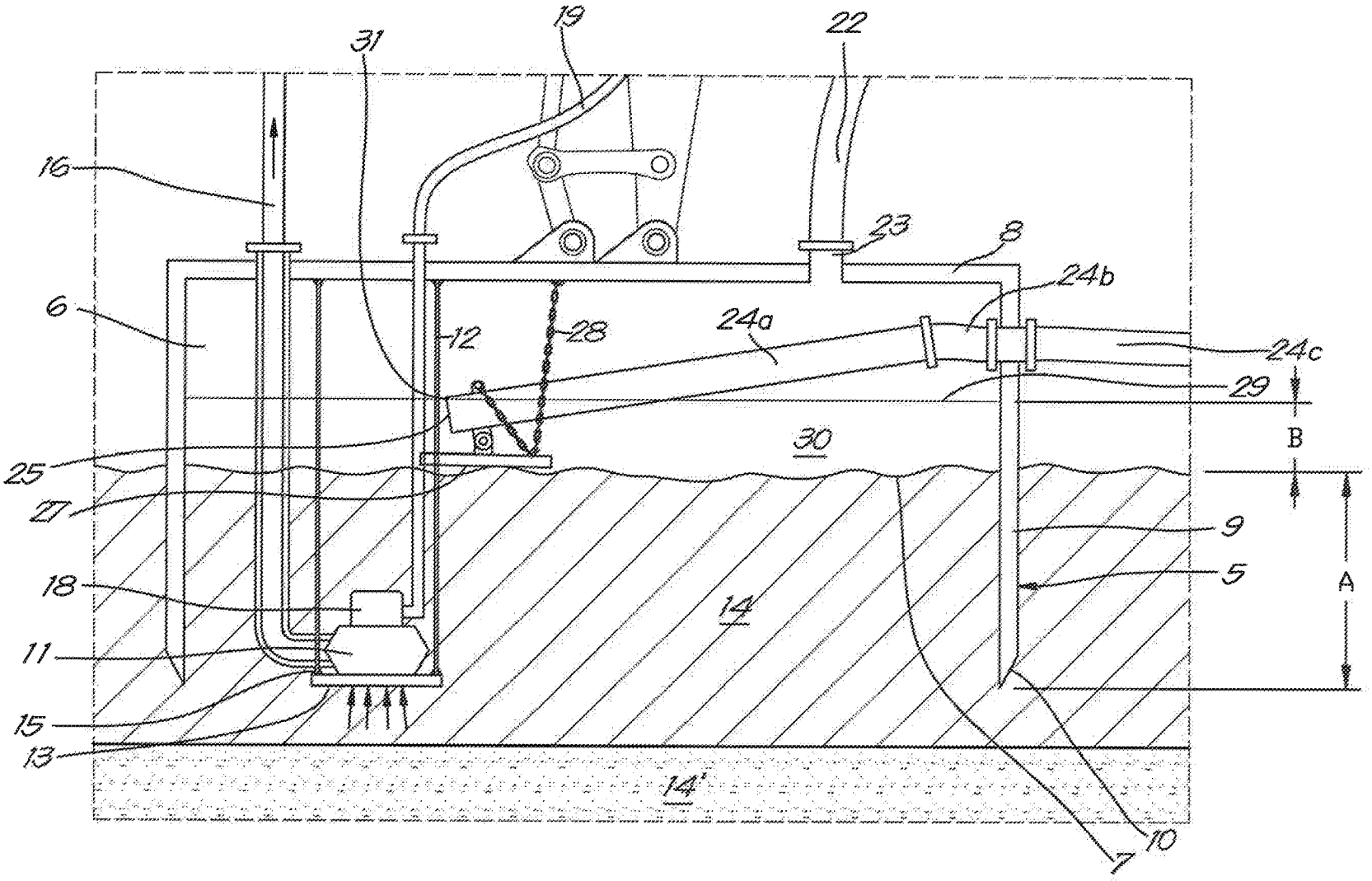

When the diving bell 5 is driven into the sludge 14 at a depth A, as shown in FIG. 2, the float 27 follows the movements of the upper level of the sludge 14 in the diving bell 5, with the tube 24*b* rotating up around the flexible coupling 24*c*, driven by the float 27.

Because the space 6 in the diving bell 6 above the sludge 14 is always connected to the outside air, as the level of the sludge 14 rises in the space 6 of the diving bell 5, the air is driven out.

In the position of FIG. 2, the supply and discharge of the compressed air in the space 6 of the diving bell 5 automatically achieves a balance of the level 29 of the water 30 in the diving bell 5 which is approximately equal to the upper edge 31 of the gas outlet 25 and thus at a fixed height B above the level 29 of the sludge 14 in the diving bell 5.

When the dredge pump 11 is driven, the sludge 14 that is enclosed in the diving bell 5 is pumped away to the collector 17.

As the dredging progresses, the level of the sludge 14 in the diving bell 5 decreases and the float 27, and thus the level 29 of the water 30, follows the level of the sludge 14 in the diving bell.

The level 30 is controlled by pumping with the dredge pump 11 until all the sludge 14 in the diving bell 5 has been pumped out, as shown in FIG. 3.

In other words, water is never driven out that could otherwise cause pollutions present in the sludge to be rinsed out.

In this way, only the sludge 14 that is caught in the diving bell 5 is dredged without disturbing the sludge 14 all around.

The level 29 of the water 30 above the level of the sludge therefore depends on the height of the upper edge 31 of the outlet 25 and can therefore be regulated by positioning it higher or lower in relation to the float 27.

Preferably, the float 27 is designed to float on the sludge 14, but yet does not have sufficient buoyancy in water to, together with the weight of the pipe 24*b*, float on the water, so that the float 27 can lower down on to the sludge 14.

To this end, the float 27 can be made as a simple sheet dimensioned in such a way that the pressure exerted by the sheet on the sludge by the weight of the tube 24*b* is less than the load-bearing capacity of the sludge.

Alternatively, the tube 24*b* can also be replaced by a flexible hose, the lower end of which is attached to the float 27 and whereby if necessary the float 27 is weighted to allow it to sink into the water on to the sludge.

The compressor 21 is set so that the maximum pressure is higher than the pressure of a water column with a height equal to the difference in level C between the water level 26 of the wetland and the blade at the lower free edge 10 of the diving bell 5.

After all the sludge 14 has been pumped out of the diving bell 5, the diving bell 5 can be driven deeper into the sludge 14 to be able to remove the deeper sludge 14 as well.

If necessary, an underlying sand layer 14' with a higher density can also be removed up to a certain depth, in which case the diving bell 5 must be driven into the sand 14' to this depth.

In this case or in the case of relatively compact sludge 14, the hydraulic crane can be equipped with a vibration or pile-driving installation to vibrate or pile-drive the diving bell into the sand or the sludge.

After dredging to the desired depth, the diving bell 5 can be pulled up again to be driven back into the sludge at another location to dredge there. In this way, consecutive dredging operations can efficiently clean up an entire area in a short period of time.

The crane 2 and the compressor 21 do not necessarily have to be mounted on a pontoon 3, but can also be installed on a quay, for example.

It is clear that instead of the hydraulic crane 2, also other means are conceivable for driving the diving bell 5 into the sludge.

The dredge pump 11 does not necessarily need a fixed position in the diving bell 5, but can, for example, be attached to a device that can move the dredge pump 11 in the diving bell 5.

Several dredge pumps 11 may also be provided.

Figure 5:
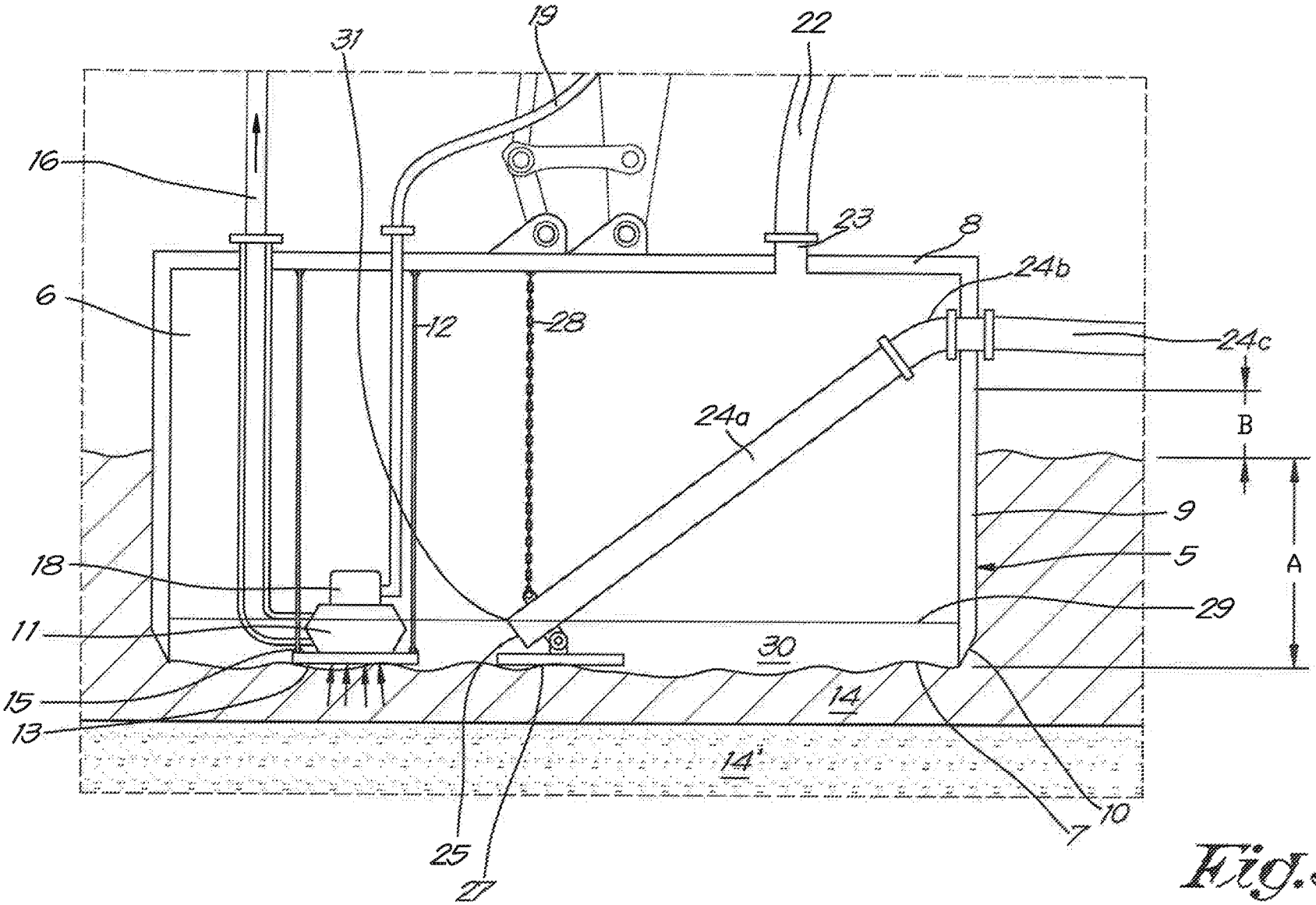
FIG. 5 shows another embodiment of the device of FIG. 1.
Figure 4:
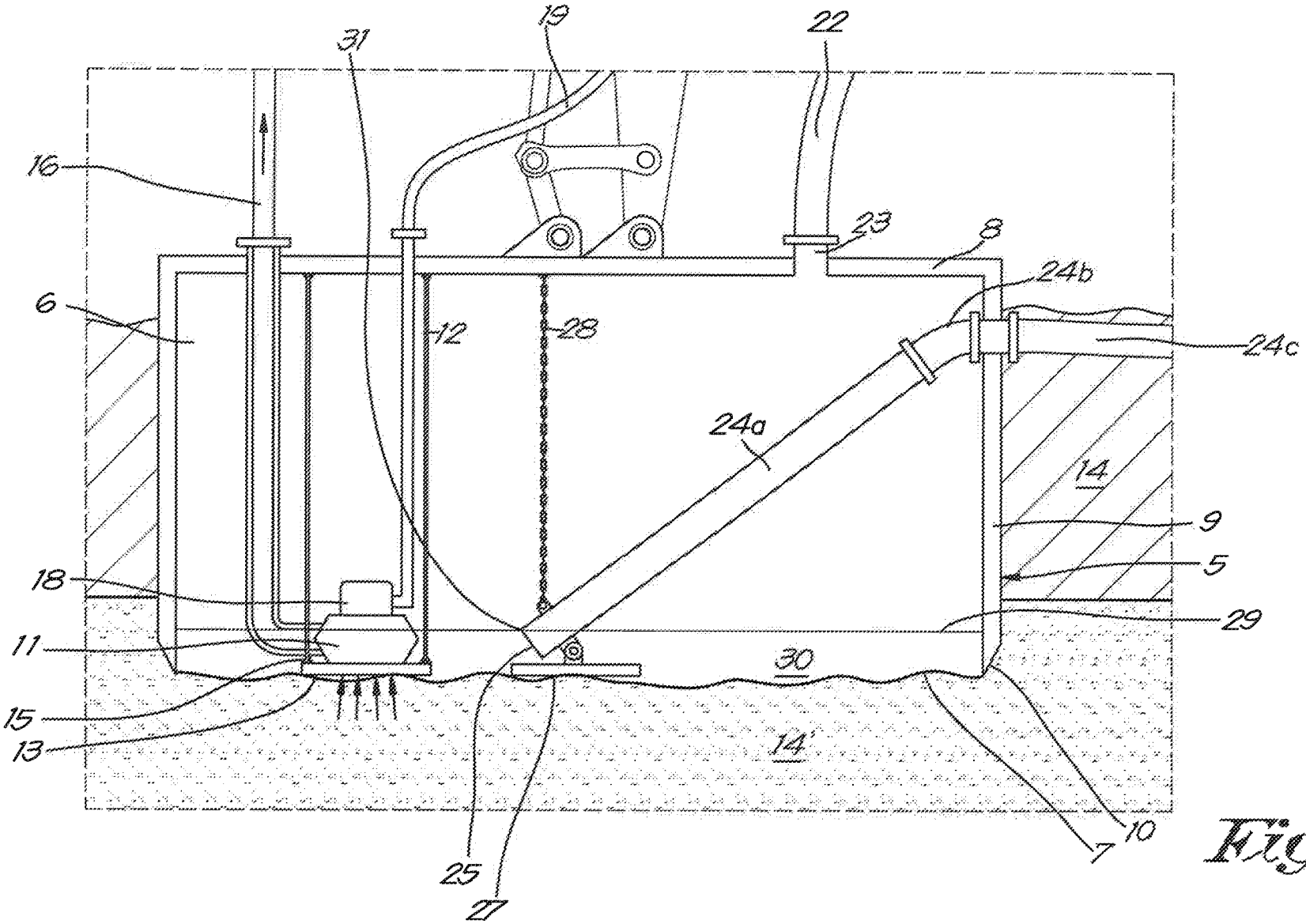
Figure 5:
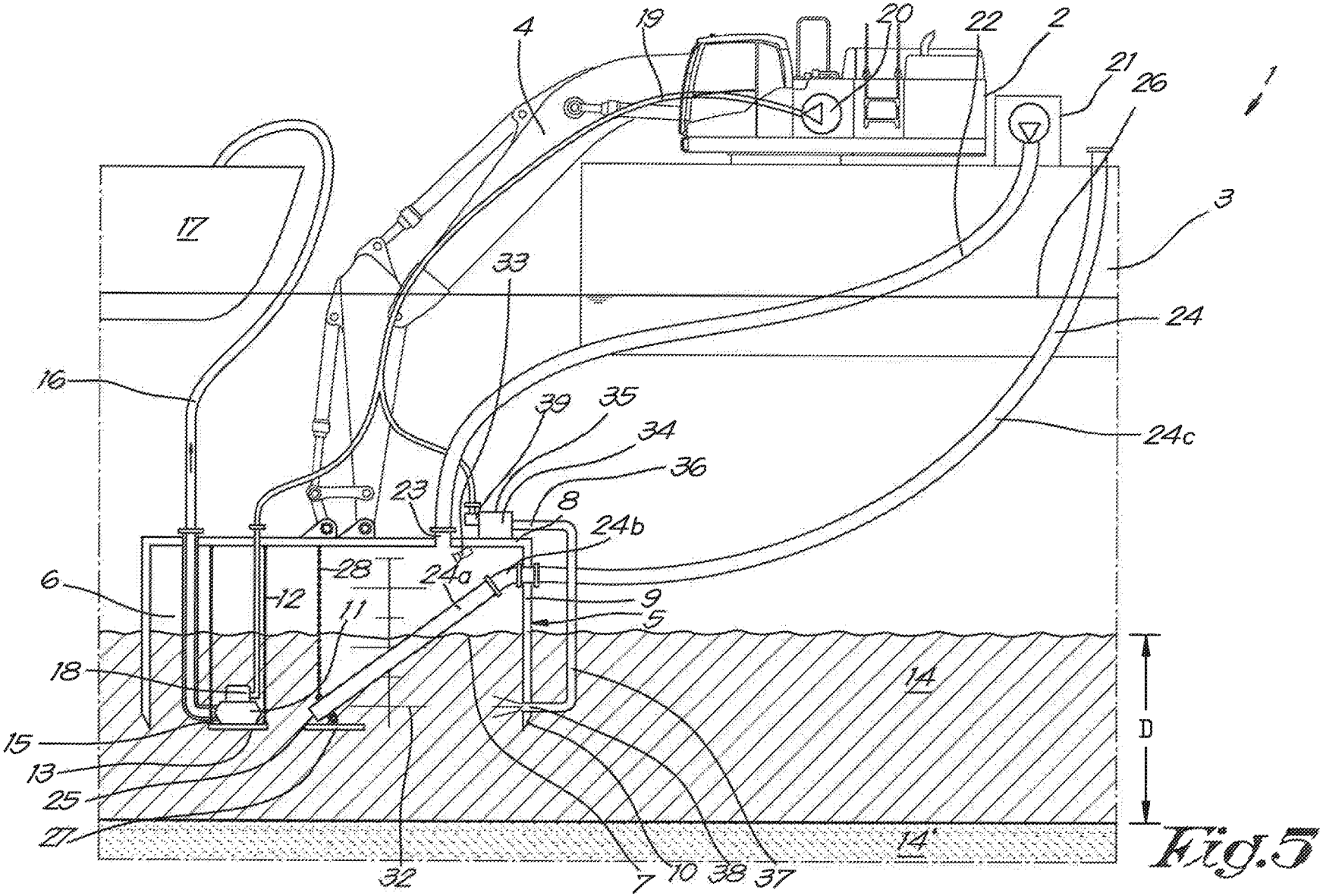

FIG. 5 shows an alternative embodiment of a device 1 according to the invention which, in relation to the device in FIG. 1, is provided with the following extra elements:

means of measuring the depth A of the diving bell 5 in the sludge 14, such as for example a depth scale 32 on a sidewall 9 of the diving bell 5 and a camera 33 to enable the crane operator in the crane 2 to see what is going on in the diving bell 5;

means (not shown) of measuring the thickness D of the layer of sludge, e.g. by means of sonar;

an installation to generate a water jet to breach hard sludge in the diving bell 5, in other words, to break it up;

a jet pump 34 with an inlet 35 on the outside of the diving bell 5 and an outlet 36 connected with pipes 37 to passages 38 on the underside of the sidewall 9 of the diving bell 5, so that a water jet is generated in a horizontal direction;

the jet pump 34 is provided with a hydraulic motor 39 which is also connected to the hydraulic unit 20 of the crane 2.

Figure 6:
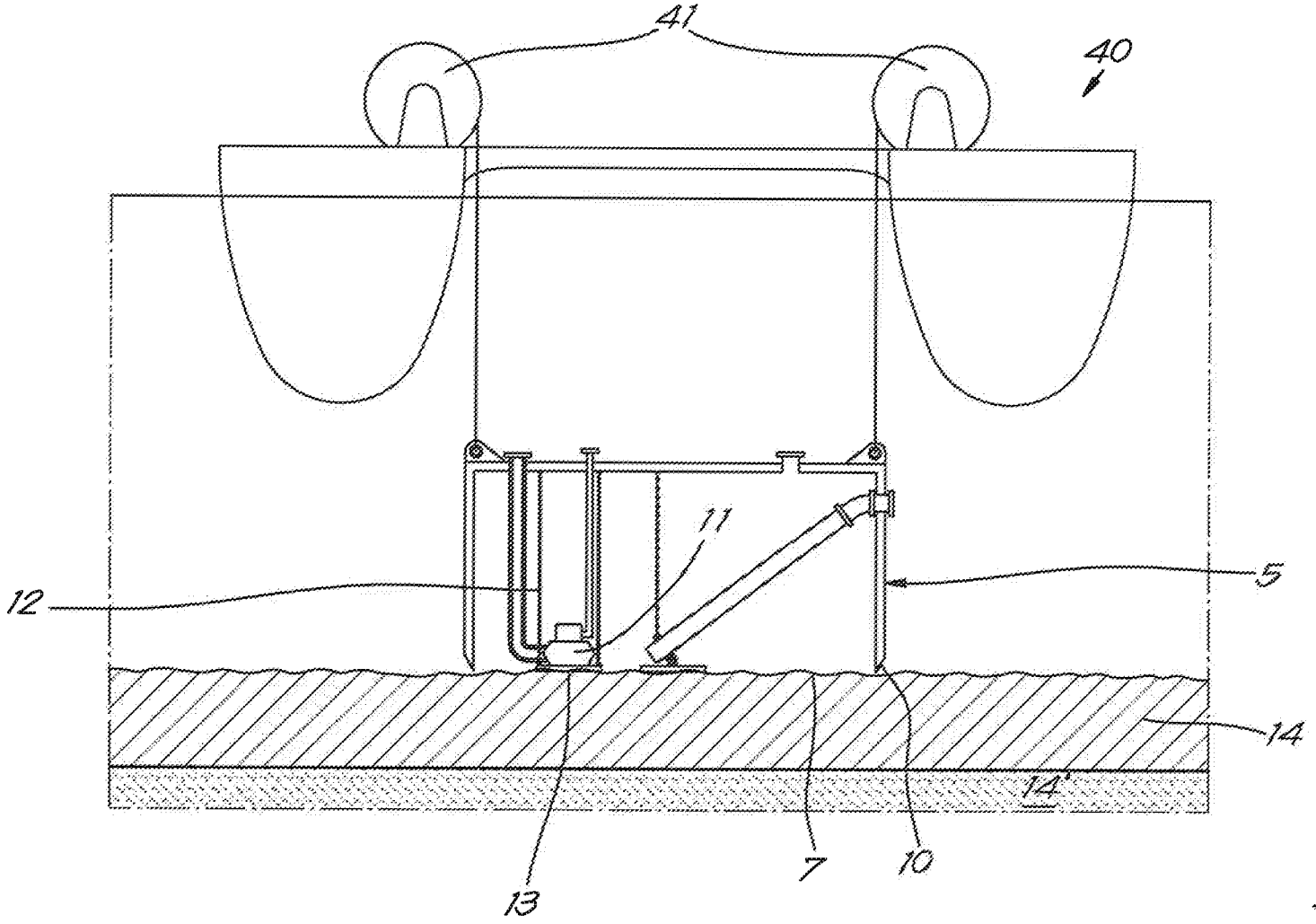
FIGS. 6 and 7 show other embodiments.

FIG. 6 shows another embodiment of a device 1 according to the invention whereby in this case the diving bell 5 is suspended by a cable from a catamaran 40 or the like, whereby the diving bell 5 can be lowered into the sludge using winches 41 or the like and can be hoisted back after the dredging work has been completed to dredge a subsequent zone. In this case too, it can be useful to install a vibration or pile-driving installation on the diving bell 5.

Figure 7:
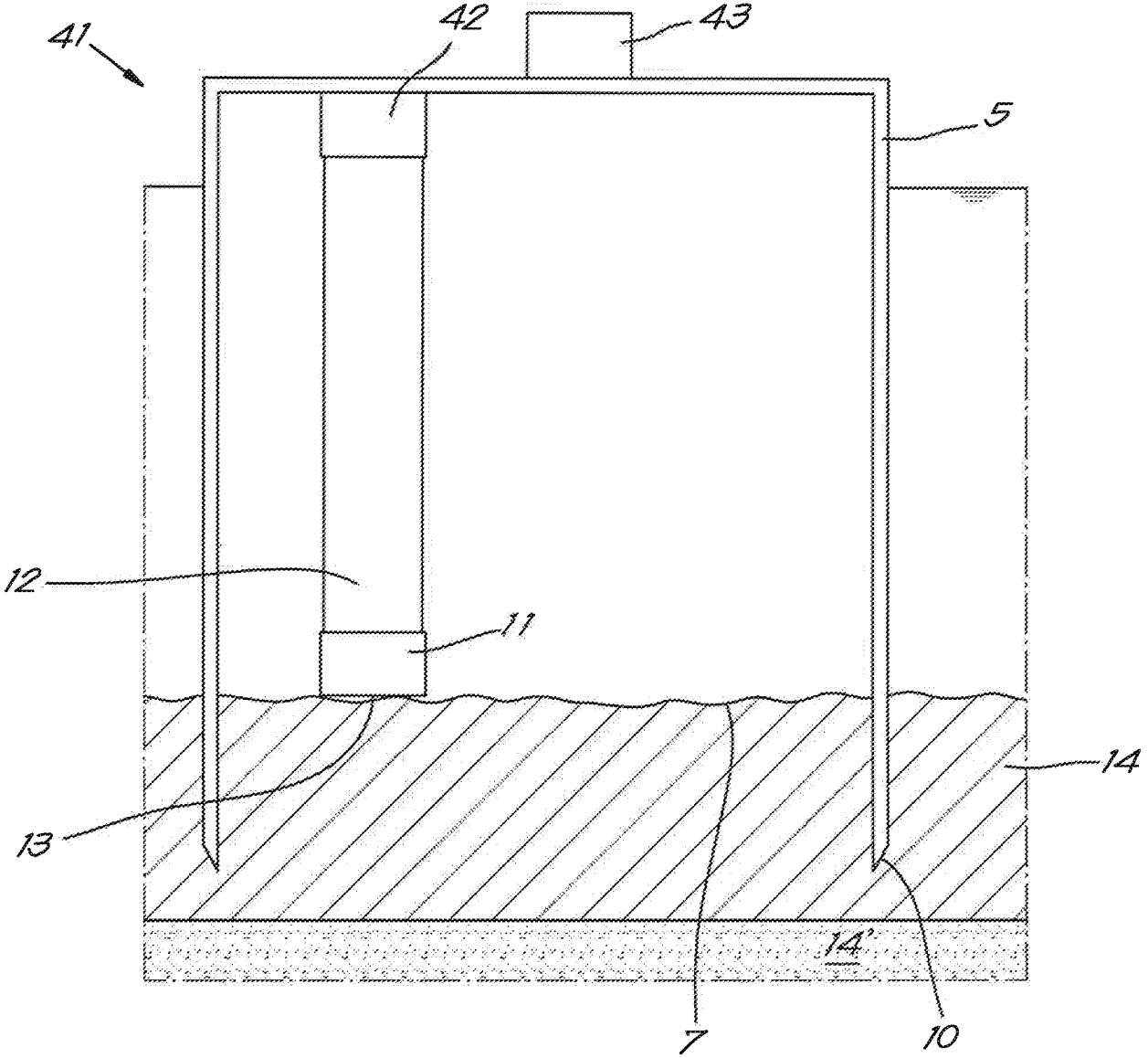

FIG. 7 describes another embodiment whereby the diving bell 5 is not completely under water to remove the sludge 14, but partly sticks out of the water.

In the example shown, the diving bell 5 is provided with means of transport 42 to move the dredge pump 11 horizontally and/or vertically within the diving bell 5 and with a vibration device 43 to vibrate the diving bell 5 in the sludge 14 and/or the sand 14'.

The present invention is by no means limited to the devices described by way of an example and shown in the figure, but, a device and a method for the removal of sludge according to the invention can be realised in all kinds of ways, without departing from the scope of the invention.

The invention claimed is:

1. Device for the in situ underwater removal of a layer of sludge and/or sand from the bottom of a wetland, the device containing:

a diving bell with an open bottom and a lower free edge;

means of driving the diving bell with the lower edge to a desired depth into the layer of sludge and/or sand to be removed;

a dredge pump installed in a space of the diving bell and provided with an inlet for pumping up the sludge and/or an outlet to which a pipe is connected for pumping the pumped up sludge and/or sand to a collector;

a compressor for pumping gas under pressure into the space of the diving bell during dredging, wherein the diving bell is also provided with a gas outlet for the compressed gas, the gas outlet being mounted to a float that is configured to float on the sludge and/or sand making the gas outlet adjustable in height in the diving bell.

2. The device according to claim 1, wherein the gas outlet is formed by an open end of a pipe which releases via an opening at a top of the diving bell into an environment.

3. The device according to claim 2, wherein the pipe discharges above a water level of the wetland.

4. The device according to claim 1, wherein the gas outlet is located with an upper edge at a small height above the float.

5. The device according to claim 1, wherein the float with the gas outlet mounted thereon, is suspended in the diving bell by means of a chain or the like having a length that is configured to have an underside of the float to be approximately at a level of the lower free edge of the diving bell when the diving bell is taken out of the water.

6. The device according to claim 2, wherein the float floats on the sludge and/or sand, but together with a weight of the pipe and gas outlet does not have sufficient buoyancy to allow the gas outlet to float on the water.

7. The device according to claim 6, wherein the float is formed by a sufficiently dimensioned sheet to bear the weight of the pipe on the sheet on the sludge and/or sand.

8. The device according to claim 2, wherein the pipe is formed by a rigid metal tube which rests and is attached to the float with one end and with an other end releases via a flexible coupling at the top of the diving bell into an environment outside of the diving bell.

9. The device according to claim 1, wherein the dredge pump is attached to a fixed place in the diving bell with the inlet on a level of the lower free edge of the diving bell.

10. The device according to claim 1, wherein a maximum pressure to which the compressor is set is higher than a pressure of a water column with a height equal to a difference in level between a water surface of the wetland and the lower free edge of the diving bell.

11. The device according to claim 1, wherein the lower free edge of the diving bell is made as a blade.

12. The device according to claim 1, wherein near the lower edge of the diving bell, the diving bell is provided with a water jet that is fed by a jet pump that sprays water into the sludge and/or sand inside.

13. The device according to claim 12, wherein the jet pump is mounted on an outside of the diving bell and via pipes is connected with passages in a wall of the diving bell, the pipes discharging into the diving bell in a direction perpendicular to the wall.

14. The device according to claim 12, wherein the means to drive the diving bell in the sludge and/or sand are formed by a hydraulic crane with a hydraulic unit that supplies hydraulic power to drive the dredge pump and the jet pump.

15. The device according to claim 14, wherein the hydraulic crane is set up on a work boat or a pontoon, together with the compressor.

16. The device according to claim 1, further comprising means to assess the depth of the diving bell in the layer of sludge and/or sand.

17. The device according to claim 16, wherein the means to assess the depth of the diving bell in the sludge and/or sand are formed by a depth scale on a sidewall of the diving bell and a camera.

18. The device according to claim 1, further comprising means to assess a thickness of the layer of sludge and/or sand.

19. A method for the removal of a layer of sludge and/or sand from the bottom of a wetland, comprising providing the device of claim 1, driving the diving bell into the layer of sludge and/or sand, and pumping the sludge and/or sand to the collector.

20. The device according to claim 2, wherein the gas outlet is located with an upper edge at a small height above the float.

* * * * *